US009882298B2

(12) United States Patent
Zeng

(10) Patent No.: US 9,882,298 B2
(45) Date of Patent: Jan. 30, 2018

(54) PLUG-IN CONNECTOR

(71) Applicant: Amphenol Commercial Products (ChengDu) Co., LTD., Chengdu (CN)

(72) Inventor: Tao Zeng, Luzhou (CN)

(73) Assignee: Amphenol Commercial Products (ChengDu) Co., LTD., Chengdu (CN)

( * ) Notice: Subject to any disclaimer, the term of this patent is extended or adjusted under 35 U.S.C. 154(b) by 0 days.

(21) Appl. No.: 15/296,067

(22) Filed: Oct. 18, 2016

(65) Prior Publication Data

US 2017/0358880 A1 Dec. 14, 2017

(30) Foreign Application Priority Data

Jun. 8, 2016 (CN) ..... 2016 1 0400679

(51) Int. Cl.
*H01R 24/00* (2011.01)
*H01R 12/72* (2011.01)
*H01R 12/70* (2011.01)

(52) U.S. Cl.
CPC ..... *H01R 12/721* (2013.01); *H01R 12/7088* (2013.01)

(58) Field of Classification Search
CPC ..... H01R 12/721; H01R 12/7088
USPC ..... 439/637
See application file for complete search history.

(56) References Cited

U.S. PATENT DOCUMENTS 8,353,726 B2 * 1/2013 Zhang ..... H01R 12/721 439/629
2004/0248470 A1 * 12/2004 Wu ..... H01R 12/716 439/637
2005/0026463 A1 * 2/2005 Harris ..... H01R 12/7088 439/65
2011/0034046 A1 * 2/2011 Zhu ..... H01R 12/7052 439/83

* cited by examiner

*Primary Examiner* — Abdullah Riyami
*Assistant Examiner* — Nader Alhawamdeh
(74) *Attorney, Agent, or Firm* — Gokalp Bayramoglu

(57) ABSTRACT

The present invention discloses a plug-in connector, including housing, fixing terminals that are connected to the first terminal part and the second terminal part detachably inserting into the clamping grooves provided inside the first terminal part and the second terminal part; at least two power supply terminals; a signal terminal mounting part, provided with two separated rows of terminal grooves therein, wherein the terminal groove includes a plurality of terminal inserting grooves and a plurality of spacing walls that are positioned between the terminal inserting grooves to separate the terminal inserting grooves from each other, and wherein a bottom of the signal terminal mounting part between two terminal groups is provided with a strip-type groove in which conductive plastic is mounted; a pair of terminal groups, having a plurality of signal terminals and ground terminals, and wherein all of the ground terminals are electrically connected through the conductive plastic.

20 Claims, 6 Drawing Sheets

PLUG-IN CONNECTOR

TECHNICAL FIELD

The present invention relates to the field of communication technology, in particular, relates to a plug-in connector.

BACKGROUND

Card connectors are mainly used in signal transmission on servers. In the prior art, when transmitting the power supply and the signal, a card connector which transmits the signal and a card connector which transmits the power supply are both needed. When transmitting the power supply and the signal, a plurality of card connectors need to be installed to perform the function. Thus, customers need to preserve a large amount of space to mount a plurality of connectors inside the server. Both the cost invested by the customer and the difficulty of mounting is increased.

In addition, in order to meet the overall smooth upgrading of the server, for example, promoting a low propagation speed of 8G signal of a server to 16G or 25G, customers need to readjust the structure of the product or add additional connectors to achieve the goal. Thus, the overall smooth upgrading of the server is difficult and costly.

SUMMARY

Compared to the above defects in the prior art, the plug-in connector provided by the present invention solves the problem in which the connector cannot perform signal shielding.

In order to achieve the above inventive purpose, the present invention uses the following technical solutions:

A plug-in connector includes a housing having, from an end on one side to an end on other side, a first end part, a power supply terminal mounting part, a connecting part, a signal terminal mounting part, and a second end part that are integrally connected together. A fixed terminal connected to the first end part and the second end part is detachably inserted into a clamping groove located on the first terminal part and the second terminal part;

At least two power supply terminals clamped onto a power supply terminal mounting part are detachably inserted inside a mounting groove located on the power supply terminal mount;

A signal terminal mounting part provided with two separated rows of terminal grooves includes a plurality of terminal inserting grooves and a plurality of spacing walls that are positioned between the terminal inserting grooves to separate the terminal inserting grooves from each other. The bottom of the signal terminal mounting part between two terminal groups is provided with a strip-type groove in which conductive plastic is mounted;

A pair of terminal groups having a plurality of signal terminals and ground terminals, wherein each of the signal terminals and each of the ground terminals are detachably plugged into a terminal inserting groove, and all of the ground terminals are electrically connected through the conductive plastic.

In one embodiment of the present invention, upper ends of both sides of the signal terminal mounting part are provided with several hole grooves, each hole groove extending through a spacing wall corresponding thereto.

In one embodiment of the present invention, the two rows of terminal grooves are provided on the signal terminal mounting part in a staggered manner, and wherein the stagger displacement of the two terminal grooves equals to half of the interval between two adjacent terminal inserting grooves.

In one embodiment of the present invention, the power supply terminal has a power supply transmission part and a supporting part for supporting the power supply transmission part, and wherein the power supply transmission part is made of pure copper, and wherein the supporting part is made of stainless steel.

In the implementation, preferably, the power supply transmission part has a first panel part, a plurality of first extending part disposed on one side of the first panel part, and a plug-in part provided on the other side of the first panel part corresponding to a spacing groove located between two adjacent first extending parts;

The supporting part has a second panel part and a second extending part that are consistent in shape with the first panel part and the first extending part respectively, and wherein the second panel part is provided with at least one clamping structure for clamping the power supply transmission part.

The beneficial effects of the present invention are that the present solution arranges the power supply terminal of the transmitting current and the terminal group of the transmitting signal on the same connector without changing the shape or the structure of existing connector. Thus, in use, customers do not need to preserve a large amount of space on the server to mount a plurality of connectors. In addition, now one connector can achieve the function of two previous connectors, such that the investment of the customer is significantly reduced.

Conductive plastic assembled inside strip-type groove which is provided on the bottom of the mounting part can isolate signal terminals between adjacent two terminal groups from each other, so as to achieve the shielding effect of the signal. At the same time, all of the ground terminals can be electrically connected together. When the consumer uses the connector of the present solution, the requirement of smooth upgrading can be achieved (without changing the design of the overall system, adding the conductive plastic into the connector, so as to increase the speed of the system is).

Since the terminal group is plugged into the terminal groove in a detachable manner, according to the desired impedance, the user can replace various types and sizes of signal terminals and ground terminals inside the terminal inserting groove.

After terminal grooves are provided in a staggered arrangement in the signal terminal mounting part, originally opposite signal terminals of two terminal groups can stagger a certain distance, such that the interval between signal terminals of one terminal group and signal terminals of the other terminal group, and therefore the anti-crosstalk performance of the signal terminal is improved.

Several hole grooves provided on both sides of signal terminal mounting part can reduce the permittivity of the connector, to increase the impedance of the connector, so as to ensure the impedance matching between the connector and other components.

The present solution design the power supply terminal as the power supply transmission part which is made of pure copper to conduct the transmission of the power supply, such that the conductive capacity of the power supply terminal is almost 100%. Since power supply transmission part is made of pure copper, it stiffness is poor. The arranged supporting part which is made of stainless steel can support power supply transmission part, increasing the retentiveness of the power supply terminal.

Figure 1:
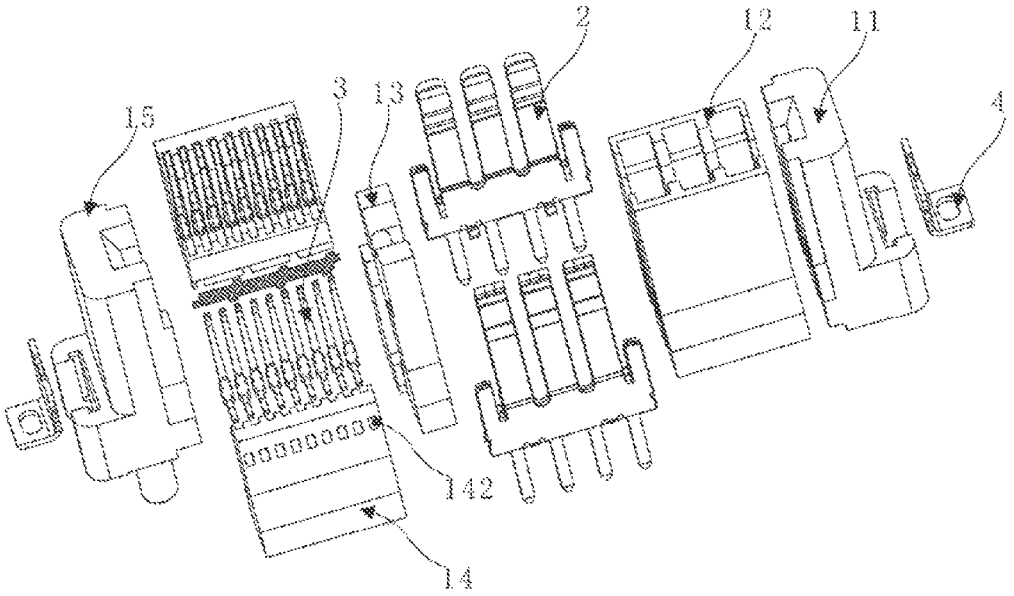
FIG. 1 is an explosive view of a plug-in connector.

In the drawings: 1, housing; 11, first terminal part; 12, power supply terminal mounting part; 121, mounting groove; 13, connecting part; 131, first projecting part; 14, signal terminal mounting part; 141, terminal inserting groove; 142, hole groove; 143, strip groove; 15, second terminal part; 151, second projecting part; 16, guide pole; 2, power supply terminal; 21, supporting part; 211, clamping part; 212, supporting part; 213, second panel part; 214, second extending part;

22, power supply transmission part; 221, gap groove; 222, spacing groove; 223, plug-in part; 224, first panel part; 225, first extending part; 3, terminal group; 31, signal terminal; 311*a*, bending segment A; 312*a*, flat segment A; 313*a*, plug-in segment A; 314*a*, clamping segment A; 315*a*, recessing groove; 316*a*, projection piece; 311*b*, bending segment B; 312*b*, flat segment B; 313*b*, plug-in segment B; 314*b*, clamping segment B; 315*b*, arc groove; 4, fixing terminal; 5, conductive plastic.

DETAILED DESCRIPTION

Hereinafter, embodiments of the present invention are described, such that a person of ordinary skill in the art can understand the present invention. However, it is clear that the present invention is not limited to the scope of embodiments. For a person of ordinary skill in the art, as long as various modifications fall within the spirit and scope of the present invention defined and determined by the accompanying claims, these modifications are obvious. Any invention using the inventive conception of the present invention is protected by the present application.

Figure 2:
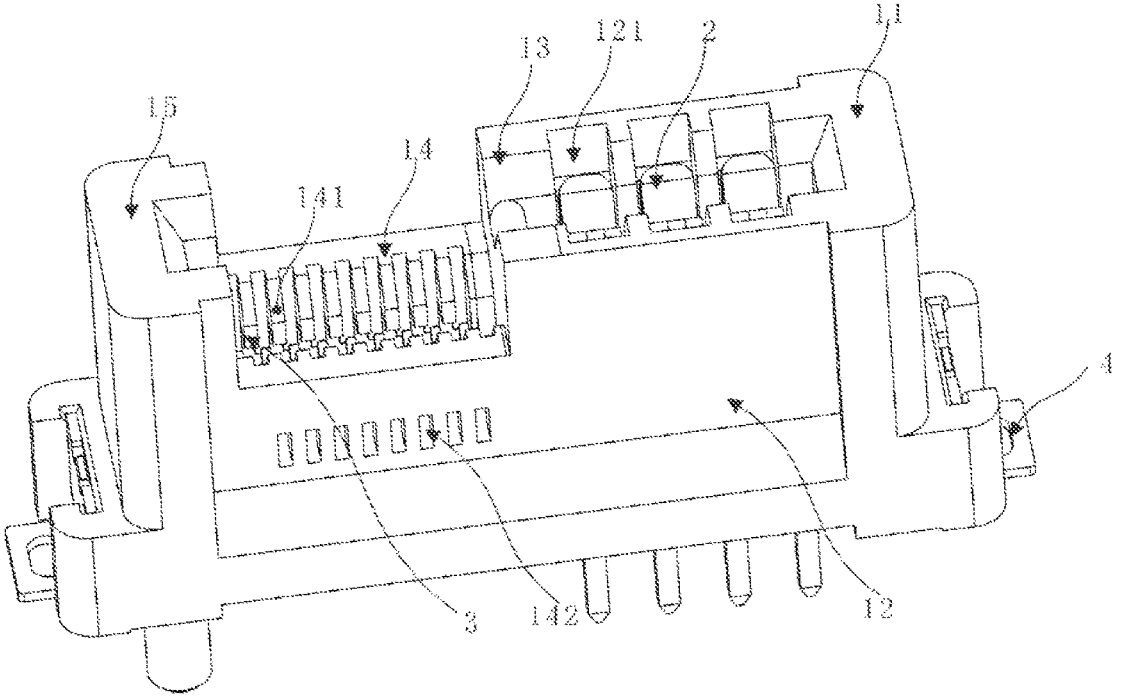
FIG. 2 is a perspective view of the plug-in connector from one angle.
Figure 3:
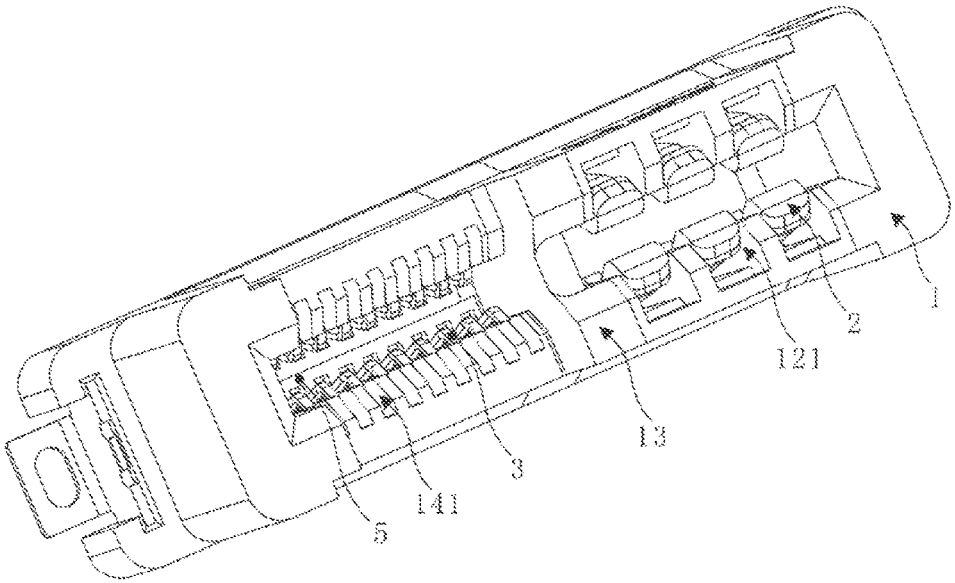
FIG. 3 is a perspective view of the plug-in connector from another angle.
Figure 4:
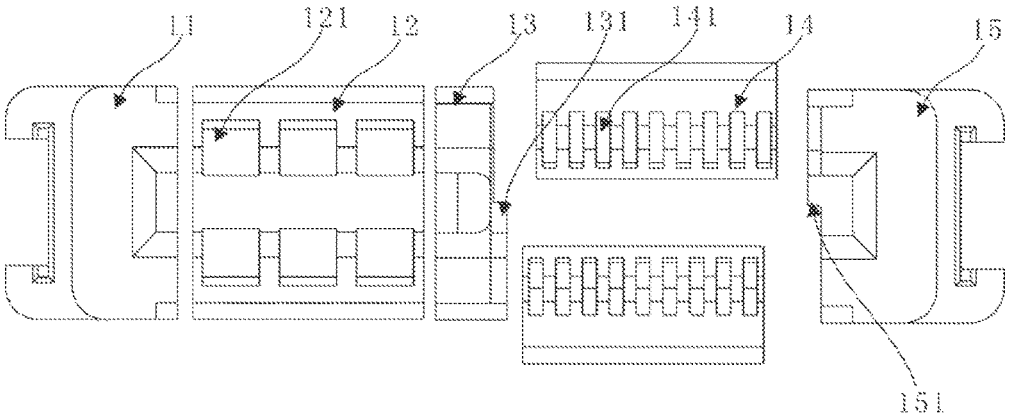
FIG. 4 is an exploded view of the housing of the plug-in connector.
Figure 5:
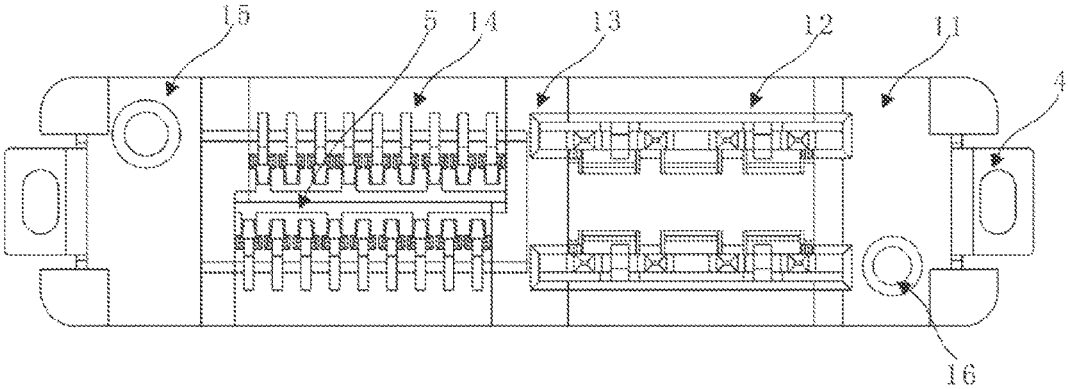
FIG. 5 is a bottom view of the plug-in connector.

Referring to FIG. 1 to FIG. 5, FIG. 1 shows an explosive view of a plug-in connector. FIG. 2 shows a perspective view of the plug-in connector from one angle. FIG. 3 shows a perspective view of the plug-in connector from another angle. FIG. 4 shows an exploded view of the housing of the plug-in connector. FIG. 5 shows a bottom view of the plug-in connector.

As shown in FIG. 1 to FIG. 5, this plug-in connector includes housing 1, at least two power supply terminals 2, a pair of terminal groups 3 (used for transmitting the signal), and a pair of fixing terminals 4.

From the end part of one side to the end part of the other side of housing 1, there are first terminal part 11, power supply terminal mounting part 12, connecting part 13, signal terminal mounting part 14, and second terminal part 15 that are connected as a whole. Housing 1 of the present solution is formed by injection molding. Various types of power supply terminal 2 and terminal group 3 can be selected to be plugged into housing 1 according to the customer's needs.

A clamping groove which is used to clamp fixing terminal 4 is located on both first terminal part 11 and second terminal part 15. When assembling fixing terminal 4, fixing terminal 4 is connected to first terminal part 11 and second terminal part 15, and is plugged into first terminal part 11 and the clamping groove located on second terminal part 15 in a detachable manner.

Fixing terminal 4 is supported by a board in an L-like shape. A mounting hole which facilitates the connector to be stably fixed on other components is located on the shorter wall of fixing terminal 4. The mounting hole is preferably configured in an oval shape.

As shown in FIG. 3 and FIG. 5, a strip-type through groove which passes through entire power supply terminal mounting part 12 is located in the vertically middle portion of power supply terminal mounting part 12. Power supply terminal mounting part 12 on both sides of strip-type through groove is disposed with mounting groove 121 which is used for mounting power supply terminal 2 respectively. Power supply terminal 2 which is clamped on power supply terminal mounting part 12 is, in a detachable manner, plugged into mounting groove 121 provided on power supply terminal mounting part 12.

As shown in FIG. 2 to FIG. 7, a strip-type through-hole which passes through the entire signal terminal mounting part 14 is positioned in the vertically middle portion of signal terminal mounting part 14. Two rows of terminal grooves that are separated from each other are located on both sides of the strip-type through hole. The terminal groove includes a plurality of terminal inserting grooves 141, and a plurality of spacing walls that are positioned between terminal inserting grooves 141 such that terminal inserting grooves 141 are separated from each other.

Since terminal group 3 is plugged into the terminal groove using a detachable manner, according to the requirement of desired impedance, the user can replace signal terminal 31 and ground terminal with various types and sizes in terminal inserting groove 141. If the deformation or the damage of terminal group 3 appears, the detachable plug-in manner can also facilitate the replacement of terminal group 3.

In addition, power supply terminal 2 and fixing terminal 4 are also mounted using a detachable manner. Once arranged as such, if deformation or damage to power supply terminal 2 or fixing terminal 4 appears, replacement or repairing of these two components can be performed quickly.

The bottom of signal terminal mounting part 14 between two terminal groups 3 is provided with strip-type groove 143. Conductive plastic 5 is fitted inside strip-type groove 143. Specifically, strip-type groove 143 is formed by the cavity between the middle portion and the lower portion of two terminal grooves.

Strip-type groove 143 and conductive plastic 5 positioned inside strip-type groove 143 can isolate signal terminal 31 between adjacent two terminal groups 3 from each other, such that shielding of the signal is realized, and at the same time, all ground terminals can be electrically connected together.

In the past, in order to upgrade a server's low propagation speed of 8G signal to 16G or 25G, customers need to readjust the structure of the product or add additional connectors to achieve the goal. Now, because of conductive plastic 5 provided inside the connector, overall smooth upgrading of the server can be directly promoted.

After positioning conductive plastic 5 inside the connector, customers do not need to consider the shape, the size, or the structure of the connector, and do not need to change the structure of other components to adapt the variation of the connector. That is, under the condition in which the high-speed signal is required, the shape and the size of the connector are unchanged.

As shown in FIG. 1, each terminal group 3 has a plurality of signal terminals 31 and ground terminals. Each signal terminal 31 and each ground terminal are plugged into terminal inserting groove 141 using a detachable manner. All of the ground terminals are electrically connected together through conductive plastic 5.

Figure 11:
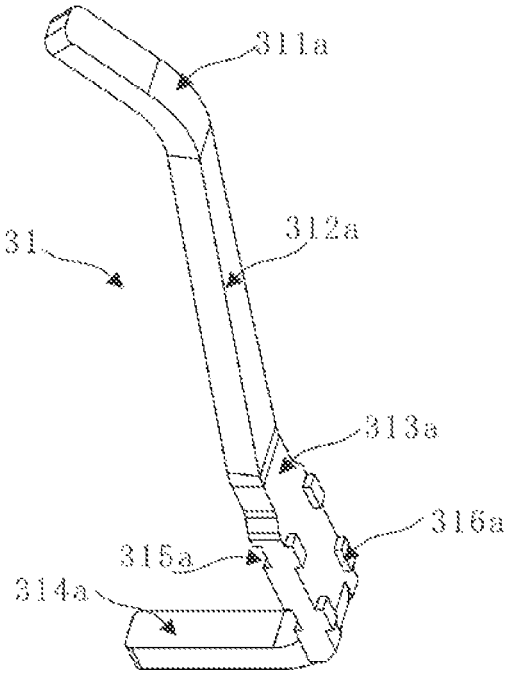
FIG. 11 is a structural schematic view of one embodiment of the signal terminal or the wire terminal.

FIG. 11 shows a structural schematic view of one embodiment of signal terminal 31 or wire terminal. As shown in FIG. 11, the structure of signal terminal 31 and that of the ground terminal are the same. Signal terminal 31 includes bending segment A 311*a*, flat segment A 312*a*, plug-in segment A 313*a*, and clamping segment A 314*a* that are connected as a whole. The transition between bending segment A 311*a* and flat segment A 312*a* is smoothed by an are portion of bending segment A 311*a*.

Flat segment A 312*a* is a board which is a substantially regular planar thin block. The transition between flat segment A 312*a* and plug-in segment A 313*a* is smoothed by an inclined plane having a certain slope of plug-in segment A 313*a*. The transition between clamping segment A 314*a* and plug-in segment A 313*a* is smoothed by an end part having a certain radian of plug-in segment A 313*a*. Also, clamping segment A 314*a* and plug-in segment A 313*a* are in a substantially perpendicular status. The backside of plug-in segment A 313*a* has a plurality of projection piece 316*a*. Locations on its front side corresponding to each projection piece 316*a* are provided with recessing groove 315*a*.

Figure 12:
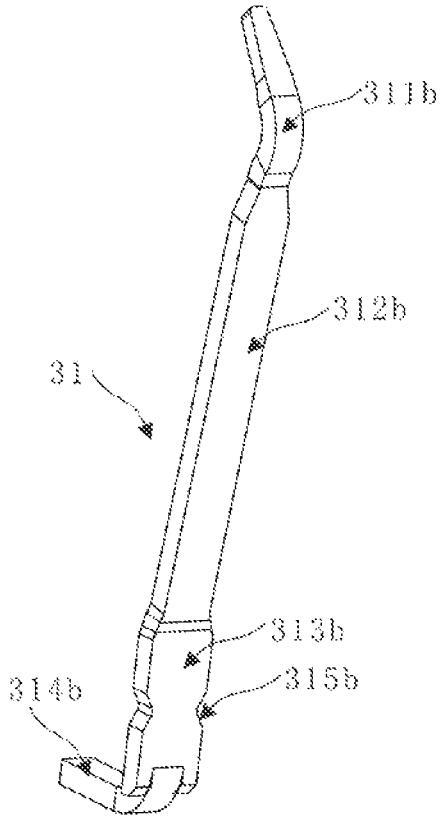
FIG. 12 is a structural schematic view of another embodiment of the signal terminal or the wire terminal.

FIG. 12 shows a structural schematic view of another embodiment of signal terminal 31 or wire terminal. As shown in FIG. 12, the structure of signal terminal 31 and that of the ground terminal are the same. Signal terminal 31 includes bending segment B 311*b*, flat segment B 312*b*, plug-in segment B 313*b*, and clamping segment B 314*b* that are connected as a whole. The transition between bending segment B 311*b* and flat segment B 312*b* is smoothed by an are portion of bending segment B 311*b*.

Flat segment B 312*b* is a board which is a substantially regular planar thin block. The transition between flat segment B 312*b* and plug-in segment B 313*b* is smoothed by an inclined plane having a certain slope of plug-in segment B 313*b*. The transition between clamping segment B 314*b* and plug-in segment B 313*b* is smoothed by an end part having a certain radian of plug-in segment B 313*b*. Also, clamping segment B 314*b* and plug-in segment B 313*b* are in a substantially perpendicular status. Both sides of plug-in segment B 313*b* are provided with arc groove 315*b*.

Signal terminal 31 of the above two types of structures both can be assembled in the same type of terminal inserting groove 141. That is, these two types of structures both can be quickly assembled inside housing 1 of the present solution. By unique configurations of terminals of the above different structures, signal terminal 31 can make the connector have different impedances.

For the structure shown in FIG. 11, it can be used in a connector which requires a low impedance, and is especially suitable for a connector which requires an impedance of around 85Ω. For the structure shown in FIG. 12, it can be used in a connector which requires a high impedance, and is especially suitable for a connector which requires an impedance of around 100Ω.

In addition, the overall width of signal terminal 31 shown in FIG. 12 is more than that of signal terminal 31 shown in FIG. 11. The length of bending segment A 311*a* is more than that of bending segment B 311*b*. The length of flat segment A 312*a* is more than that of flat segment B 312*b*. The length of clamping segment A 314*a* is more than that of clamping segment B 314*b*.

Figure 6:
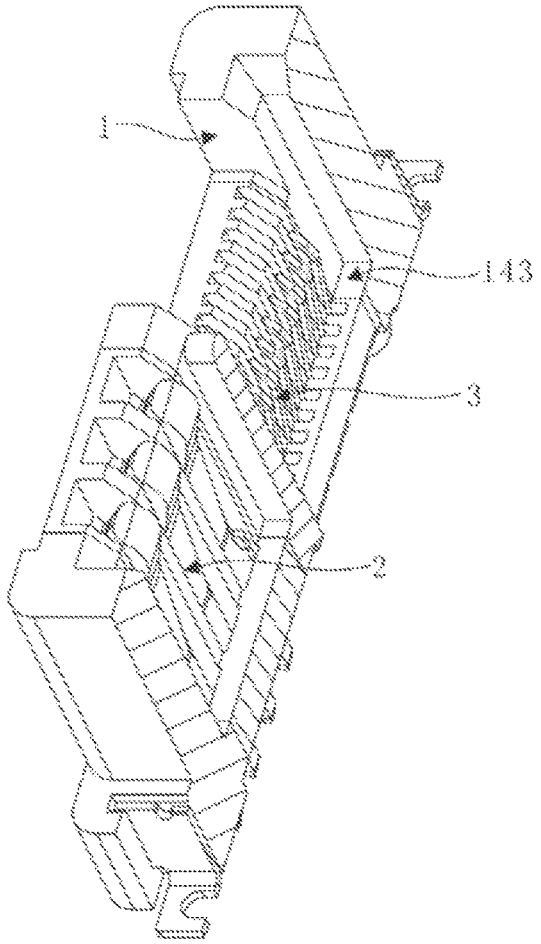
FIG. 6 is a perspective view of the plug-in connector after being half sectioned.
Figure 7:
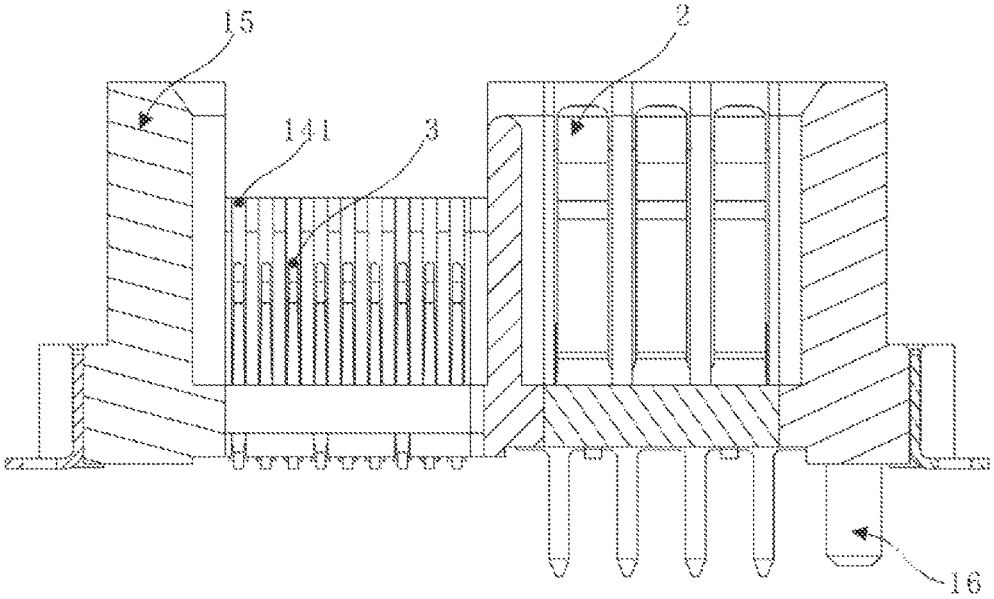
FIG. 7 is a sectional view of the plug-in connector.

As shown in FIG. 6, in use, plug-in segment A 313*a*, clamping segment A 314*a*, plug-in segment B 313*b*, and clamping segment B 314*b* are all located in terminal inserting groove 141. Specifically, plug-in segment A 313*a*, clamping segment A 314*a*, plug-in segment B 313*b*, and clamping segment B 314*b* are substantially embedded inside signal terminal mounting part 14. After arranged as such, it is ensured that signal terminal 31 and the ground terminal are securely clamped inside signal terminal mounting part 14.

In the implementation, preferably, signal terminal 31 and ground terminal are in a staggered arrangement. Moreover, one ground terminal is arranged between every two signal terminals 31. The aim of the staggered arrangement of signal terminal 31 and ground terminal is that, when the high-speed transmission is reached, the integrity of signal is better, and the ground terminal has a shielding effect. Both sides of conductive plastic 5 have a plurality of projection portions. Each projection portion and one ground terminal are electrically connected together.

As shown in FIG. 1, FIG. 2, FIG. 5, and FIG. 7, in order to facilitate the mounting of the plug-in connector onto the server quickly and securely, guide pole 16 whose free end part is an arc is provided on both sides of the bottom of housing 1 in a staggered arrangement.

In one embodiment of the present invention, the upper end of both sides of signal terminal mounting part 14 is provided with several hole grooves 142. Each hole groove 142 passes through the corresponding spacing wall. The arrangement of several hole grooves 142 can reduce the permittivity of the connector, and increase the impedance, so as to ensure the impedance between the connector and other components matches.

As shown in FIG. 3, and FIG. 4, two rows of terminal grooves are located on signal terminal mounting part 14 in a staggered arrangement. The displacement between two terminal grooves that are staggered is equal to one-half of the interval between two adjacent terminal inserting grooves 141.

After the terminal groove is arranged in signal terminal mounting part 14 in a staggered arrangement, originally opposite signal terminals 31 of two terminal groups 3 can be made staggered with each other for a certain distance, increasing the interval between signal terminal 31 in one terminal group 3 and signal terminal 31 in another terminal group, such that the anti-crosstalk performance of signal terminal 31 is improved.

As shown in FIG. 4, terminal grooves in a staggered arrangement can be achieved in following manners:

First projecting part 131 and second projecting part 151 are located on connecting part 13 and second terminal part 15 respectively to make two terminal grooves staggered. In order to ensure that two terminal grooves separate from each other, the extending surfaces of adjacent sidewalls of first projecting part 131 and second projecting part 151 do not overlap.

In order to ensure that the connector has a better anti-crosstalk performance, the interval between two adjacent terminal inserting grooves 141 is preferably 0.4 mm~0.8 mm.

Figure 8:
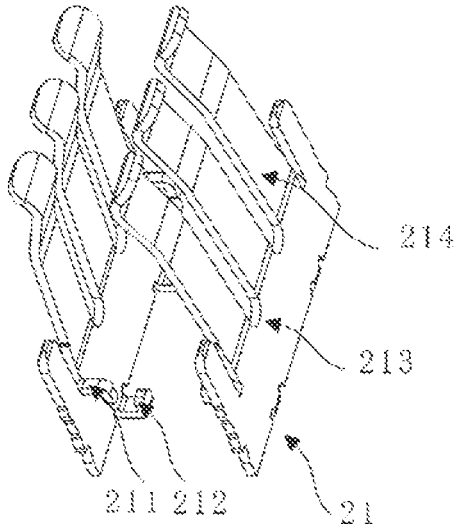
FIG. 8 is a perspective view of the supporting part of the power supply terminal.
Figure 9:
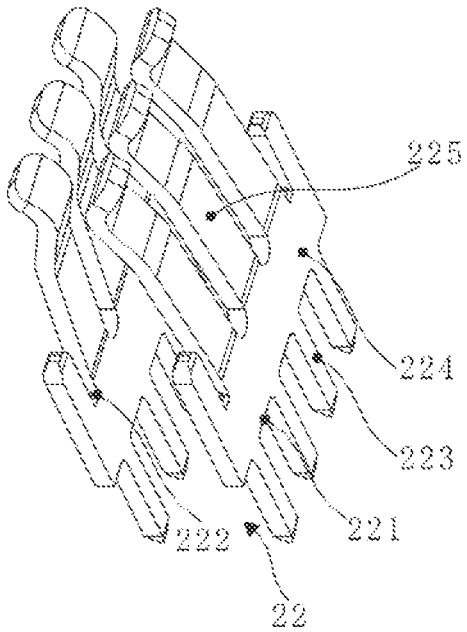
FIG. 9 is a perspective view of the power supply transmission part of the power supply terminal.
Figure 10:
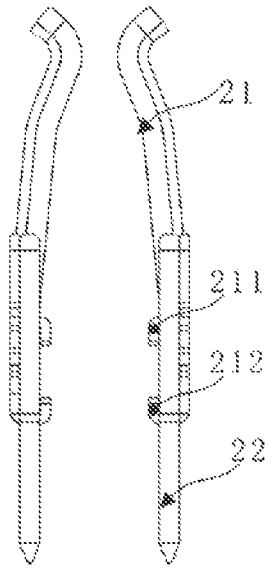
FIG. 10 is a side view of a pair of power supply terminals.

A shown in FIG. 8 to FIG. 10, power supply terminal 2 has power supply transmission part 22 and supporting part 21 which is used to support power supply transmission part 22. The material of power supply transmission part 22 is pure copper. The material of supporting part 21 is stainless steel.

In the present solution, power supply terminal 2 is designed as power supply transmission part 22, which is made of pure copper to conduct the transmission of power supply. Thus, the conductive capacity of power supply terminal 2 is almost 100%. Since power supply transmission part 22 is made of pure copper, its stiffness is poor. The arranged supporting part 21 which is made of stainless steel can support power supply transmission part 22, increasing the retentiveness of power supply terminal 2.

In the implementation, preferably, following structures are selected to improve the conductivity of power supply transmission part 22 and supporting part 21.

As shown in FIG. 9, power supply transmission part 22 has first panel part 224, a plurality of first extending parts 225 positioned on one side of first panel part 224, and plug-in part 223 positioned on the other side of first panel part 224 corresponding to spacing groove 222 between two adjacent first extending parts 225.

As shown in FIG. 8, supporting part 21 has second panel part 213 and second extending part 214 that have the same shapes of those of first panel part 224 and first extending part 225 respectively. Second panel part 213 is provided with at least one clamping structure used for clamping power supply transmission part 22.

After power supply transmission part 22 and supporting part 21 use the above structures, the structure mounting groove 121 is designed to include a plurality of upper extending part clamping grooves, board-like part clamping grooves that communicate with a plurality of extending part clamping grooves, and a plurality of plug-in part clamping grooves that communicate with the board-like part clamping groove. The upper end of mounting groove 121 has a plurality of spacing walls that are positioned between extending part clamping grooves such that extending part clamping grooves separate from each other. The lower end of mounting groove 121 further has a plurality of spacing walls that are positioned between board-like part clamping grooves such that board-like part clamping grooves separate from each other.

As shown in FIG. 8 and FIG. 9, the clamping structure consists of upwards hook part 212 and clamping part 211 which is used downwards in pair with hook part 212. When supporting part 21 supports power supply transmission part 22, hook part 212 is clamped inside gap groove 221 which is formed between two adjacent plug-in parts 223. Clamping part 211 is clamped inside spacing groove 222 which is adjacent to gap groove 221.

In use, in order to ensure the stability of power supply transmission part 22 mounted inside mounting groove 121, a plurality of clamping structures can be disposed on supporting part 21. However, the selection of the number of clamping structures, can also be flexibly configured according to various widths of power supply terminal 2.

What is claimed is:

1. A plug-in connector comprising:

a housing having, from an end on one side to an end on other side, a first end part, a power supply terminal mounting part, a connecting part, a signal terminal mounting part, and a second end part that are connected as a whole, wherein a fixed terminal connected to the first end part and the second end part is detachably inserted into a clamping groove provided on the first terminal part and the second terminal part;

at least two power supply terminals, wherein the power supply terminals clamped on a power supply terminal mounting part are detachably inserted inside a mounting groove provided on the power supply terminal mount;

a signal terminal mounting part, provided with two separated rows of terminal grooves therein, wherein the terminal groove includes a plurality of terminal inserting grooves and a plurality of spacing walls that are positioned between the terminal inserting grooves to separate the terminal inserting grooves from each other, and wherein a bottom of the signal terminal mounting part between two terminal groups is provided with a strip-type groove in which conductive plastic is mounted; and a pair of terminal groups, having a plurality of signal terminals and ground terminals, wherein each of the signal terminals and each of the ground terminals are detachably plugged into a terminal inserting groove, and wherein all of the ground terminals are electrically connected through the conductive plastic.

2. The plug-in connector according to claim 1, wherein the signal terminals and the ground terminals are arranged in such a stagger manner that one ground terminal is located between every two signal terminals, and wherein both sides of the conductive plastic have a plurality of projection parts, each projection part being electrically connected to the ground terminal.

3. The plug-in connector according to claim 1, wherein upper ends of both sides of the signal terminal mounting part are provided with several hole grooves, each hole groove extending through a spacing wall corresponding thereto.

4. The plug-in connector according to claim 1, wherein the two rows of terminal grooves are provided on the signal terminal mounting part in a staggered manner, and wherein the stagger displacement of the two terminal grooves equals to half of the interval between two adjacent terminal inserting grooves.

5. The plug-in connector according to claim 4, wherein the connecting part and the second end part are respectively provided with first projecting parts and second projecting parts that stagger the two rows of terminal grooves, and wherein extending surfaces of the adjacent side walls of the first projecting part and the second projecting part have no overlapped portion therebetween.

6. The plug-in connector according to claim 1, wherein the power supply terminal has a power supply transmission part and a supporting part for supporting the power supply transmission part, and wherein the power supply transmission part is made of pure copper, and wherein the supporting part is made of stainless steel.

7. The plug-in connector according to claim 3, wherein the power supply terminal has a power supply transmission part and a supporting part for supporting the power supply transmission part, and wherein the power supply transmission part is made of pure copper, and wherein the supporting part is made of stainless steel.

8. The plug-in connector according to claim 4, wherein the power supply terminal has a power supply transmission part and a supporting part for supporting the power supply transmission part, and wherein the power supply transmission part is made of pure copper, and wherein the supporting part is made of stainless steel.

9. The plug-in connector according to claim 6, wherein the power supply transmission part has a first panel part, a plurality of first extending part disposed on one side of the first panel part, and a plug-in part provided on other side of the first panel part corresponding to a spacing groove located between two adjacent first extending parts; and wherein the supporting part has a second panel part and a second extending part that are consistent in shape with the first panel part and the first extending part respectively, and wherein the second panel part is provided with at least one clamping structure for clamping the power supply transmission part.

10. The plug-in connector according to claim 7, wherein the power supply transmission part has a first panel part, a plurality of first extending part disposed on one side of the first panel part, and a plug-in part provided on other side of the first panel part corresponding to a spacing groove located between two adjacent first extending parts; and wherein the supporting part has a second panel part and a second extending part that are consistent in shape with the first panel part and the first extending part respectively, and wherein the second panel part is provided with at least one clamping structure for clamping the power supply transmission part.

11. The plug-in connector according to claim 8, wherein the power supply transmission part has a first panel part, a plurality of first extending part disposed on one side of the first panel part, and a plug-in part provided on other side of the first panel part corresponding to a spacing groove located between two adjacent first extending parts; and wherein the supporting part has a second panel part and a second extending part that are consistent in shape with the first panel part and the first extending part respectively, and wherein the second panel part is provided with at least one clamping structure for clamping the power supply transmission part.

12. The plug-in connector according to claim 9, wherein the clamping structure consists of an upward hook part and a downward clamping part which is used in pair with the hook part, wherein when the supporting part supports the power supply transmission part, the hook part is clamped inside a gap groove formed between two adjacent plug-in parts, and wherein the clamping part is clamped inside the spacing groove adjacent to the gap groove.

13. The plug-in connector according to claim 10, wherein the clamping structure consists of an upward hook part and a downward clamping part which is used in pair with the hook part, wherein when the supporting part supports the power supply transmission part, the hook part is clamped inside a gap groove formed between two adjacent plug-in parts, and wherein the clamping part is clamped inside the spacing groove adjacent to the gap groove.

14. The plug-in connector according to claim 11, wherein the clamping structure consists of an upward hook part and a downward clamping part which is used in pair with the hook part, wherein when the supporting part supports the power supply transmission part, the hook part is clamped inside a gap groove formed between two adjacent plug-in parts, and wherein the clamping part is clamped inside the spacing groove adjacent to the gap groove.

15. The plug-in connector according to claim 1, wherein the signal terminal and the ground terminal have the same structure, wherein the signal terminal includes a bending segment A, a flat segment A, a plug-in segment A, and a clamping segment A, which are connected as a whole, and wherein a backside of the plug-in segment A has a plurality of projection pieces and recessing grooves are provided on the front side of the plug-in segment A at positions corresponding to each projection piece.

16. The plug-in connector according to claim 3, wherein the signal terminal and the ground terminal have the same structure, wherein the signal terminal includes a bending segment A, a flat segment A, a plug-in segment A, and a clamping segment A, which are connected as a whole, and wherein a backside of the plug-in segment A has a plurality of projection pieces and recessing grooves are provided on the front side of the plug-in segment A at positions corresponding to each projection piece.

17. The plug-in connector according to claim 4, wherein the signal terminal and the ground terminal have the same structure, wherein the signal terminal includes a bending segment A, a flat segment A, a plug-in segment A, and a clamping segment A, which are connected as a whole, and wherein a backside of the plug-in segment A has a plurality of projection pieces and recessing grooves are provided on the front side of the plug-in segment A at positions corresponding to each projection piece.

18. The plug-in connector according to claim 1, wherein the signal terminal and the ground terminal have the same structure, wherein the signal terminal includes a bending segment B, a flat segment B, a plug-in segment B, and a clamping segment B, which are connected as a whole, and wherein both sides of the plug-in segment B are provided with an arc groove.

19. The plug-in connector according to claim 3, wherein the signal terminal and the ground terminal have the same structure, wherein the signal terminal includes a bending segment B, a flat segment B, a plug-in segment B, and a clamping segment B, which are connected as a whole, and wherein both sides of the plug-in segment B are provided with an arc groove.

20. The plug-in connector according to claim 4, wherein the signal terminal and the ground terminal have the same structure, wherein the signal terminal includes a bending segment B, a flat segment B, a plug-in segment B, and a clamping segment B, which are connected as a whole, and wherein both sides of the plug-in segment B are provided with an arc groove.

* * * * *